United States Patent [19]

Jenni

[11] Patent Number: 4,470,235

[45] Date of Patent: Sep. 11, 1984

[54] PILLAR FOR SUPPORTS AND WALL ELEMENTS

[75] Inventor: Albert Jenni, Binningen, Switzerland

[73] Assignee: Protoned B.V., Amsterdam, Netherlands

[21] Appl. No.: 355,508

[22] Filed: Mar. 8, 1982

[30] Foreign Application Priority Data

Mar. 23, 1981 [CH] Switzerland ..... 1961/81

[51] Int. Cl.[3] ..... E04C 3/30

[52] U.S. Cl. ..... 52/282; 52/730; 52/731

[58] Field of Search ..... 52/730, 732, 282, 233, 52/DIG. 8, 716, 727, 731

[56] References Cited

U.S. PATENT DOCUMENTS

| | | | |
|---|---|---|---|
| 3,370,389 | 2/1968 | Macaluso | 52/282 X |
| 3,491,584 | 1/1970 | Selzer | 52/727 X |
| 3,559,357 | 2/1971 | Lowe | 52/730 X |
| 3,706,169 | 12/1972 | Rensch | 52/732 X |
| 3,995,402 | 12/1976 | Parenteau | 52/282 X |

*Primary Examiner*—Carl D. Friedman

*Attorney, Agent, or Firm*—Ladas & Parry

[57] ABSTRACT

A pillar comprises a profiled metal core with a plurality of radial arms distributed over the circumference, the arms being provided with longitudinally extending slots limited by lateral wall members, the slots being adapted for the insertion of portions of supports and/or wall elements. A plurality of filling members, which may have a decorative finish, are inserted and fitted by means of groove and rib connections in sector-shaped spaces between adjacent wall members.

2 Claims, 2 Drawing Figures

PILLAR FOR SUPPORTS AND WALL ELEMENTS

This invention relates to a pillar for supports and wall elements.

Pillars or uprights of this kind are provided with profile elements at least in the region of connectors for the supports or wall elements, or have a profiled core containing cut-outs for connection or centering, and may advantageously be used for erecting temporary room partitions or as uprights in goods display shelving. The profile elements or cores which are almost always made of metal, for safety reasons, have to be as small as possible in cross-section in order to save materials, and therefore have at least some surface areas with sharp edges and/or an aesthetically unsatisfactory appearance.

An object of the invention is to provide a pillar of the kind described above, which avoids sharp edges and areas which are not adapted in appearance to the surroundings.

A further object of the invention is to provide a pillar with radial connectors, more particularly for supports and wall elements, with a profiled core which ensures that the pillar has the required dimensions and stability, whilst the appearance of the pillar should be adaptable to suit the requirements of construction, for example by means of replaceable surface elements, and which can be adapted to suit the environment or the desired appearance of the equipment in which the pillar is to be used.

According to the invention, there is provided a pillar for supports and/or wall elements, comprising an elongate profiled core having a plurality of arms extending along the length of the core and extending outwardly of the core, each arm comprising at least two wall members defining at least one slot therebetween adapted to receive a portion of a support or wall element; and a plurality of filling members, each filling member extending over at least part of the length of said core and being secured in recesses defined by at least two walls of said core by means of interlocking portions provided on the surfaces of the core and the filling member.

Two embodiments by way of example of the invention are described hereinafter with reference to the drawings.

Figure 1:
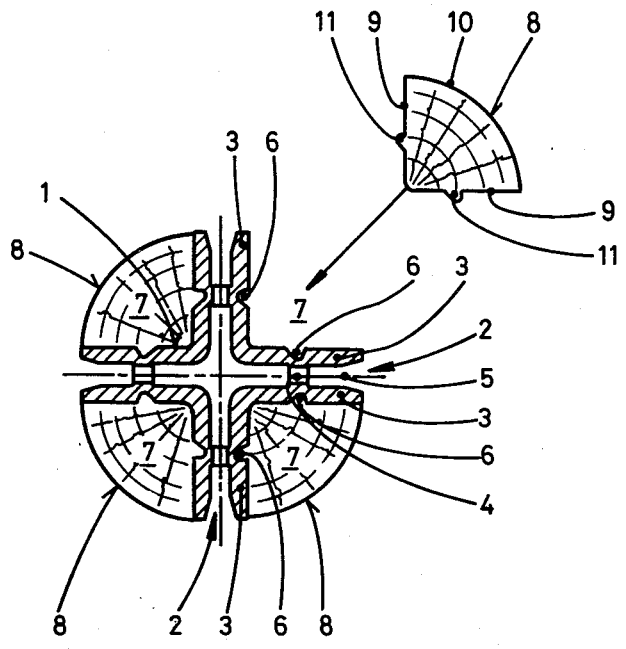
FIG. 1 is a cross-section through a first embodiment of the invention, comprising a cross-shaped profile with centering and insertion slots in each of four arms whilst the recesses between adjacent arms are provided with inserted wood sections to give the pillar the appearance of a circular cross-section.

As shown in FIG. 1, a pillar comprises a profiled core 1 having four radially extending arms 2, each of which is formed by two parallel wall members 3 which are connected to each other approximately halfway along their radial length by means of a transverse way along their radial length by means of a transverse rib 4. The transverse rib 4 determines the width of a slot 5 in which the brackets or engagement hooks of wall elements and the like (not shown) can be inserted and/or centered. The profiled column 1 is preferably made of metal or a plastics material, for example by extrusion, whilst the ends may be provided with connectors or end pieces. Each wall member 3 of each arm 2 is provided with an engaging groove 6 on its outer surface. The engaging grooves 6 provided in the facing wall members 3 of adjacent arms 2 form a pair of co-operating grooves which serve to hold a filling member 8 inserted in the corner space 7 between the two adjacent arms 2.

Each filling member 8 is sector-shaped in cross-section, having two radial faces 9 formed so as to fit tightly against the outer surfaces of the abutting wall members 3 of adjacent arms 2, and the circumferential surface 10 is designed in accordance with the desired cross-sectional configuration of the pillar. The quadrant shape shown in FIG. 1 corresponds to the circumferential shape needed to give a substantially cylindrical shape to the pillar. It will be appreciated that virtually any desired shape and decorative effect can be obtained, owing to the inherently free shape of the circumferential surface 10. Since, moreover, the filling members 8 can simply be fitted to the column profile 1 and removed again without doing any damage, the configuration of the pillar can subsequently be altered as desired, simply by changing the filling members 8. The length of the filling members 8 may be freely chosen, so that any portions of the corner space 7 not covered up may be available for securing or receiving any wall elements or supports.

Each radial face 9 of the filling member 8 has an anchoring rib 11 thereon, the form and position of which are designed to be at least approximately complementary to the grooves 6 provided facing one another in the corner spaces 7. Depending on the elasticity of the material used to produce the filling member 8, the filling member may be inserted by pressing it in laterally, whilst the filling member is held in place by the flexible snap-fitting of the anchoring ribs 11 in the engaging grooves. This method of assembly is suitable when soft plastics materials are used for the filling members. In the case of filling members made of hard or incompressible materials, such as wood, hard plastics and the like, the filling member is fitted by being axially inserted in the angular space 7 in question.

Figure 2:
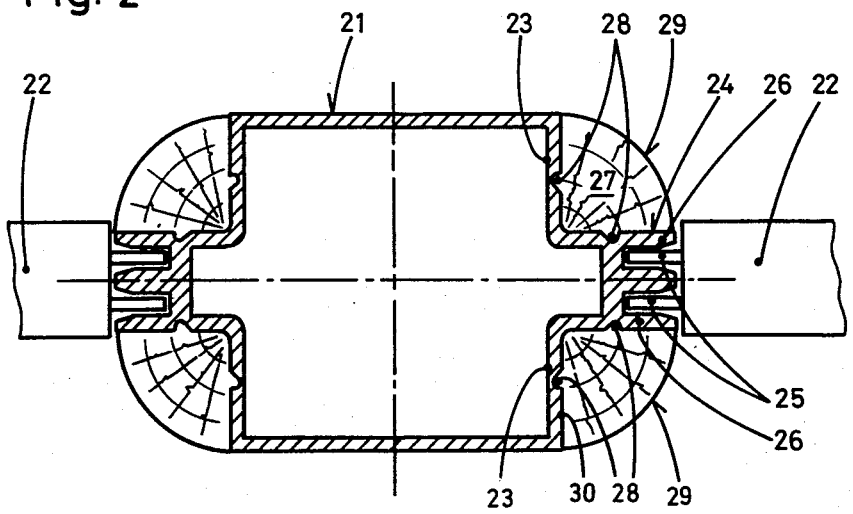
FIG. 2 is a cross-section through a second embodiment of the invention, comprising a box-shaped profile with two wall element connector arms arranged on opposite sides of the box, whilst the recesses on each side of the arms are provided with inserted wood sections of the kind shown in FIG. 1.

FIG. 2 shows a second embodiment of a pillar according to the invention comprising a box-shaped profile 21 forming a profiled core, the pillar being in the form of a substantially rectangular support post with rounded edges between two wall elements 22. Lateral wall members 23 are formed as support surfaces for a guide channel arrangement 24 in which centering and/or locking members 25 provided on the ends of the wall elements 22 are guided or held. The outer walls 26 of the guide channel arrangement 24 and the lateral wall members 23 are arranged in the same configuration as the wall members 3 of the embodiment of FIG. 1 and define a corner space 27 similar to the corner space 7 in FIG. 1.

Engaging grooves 28 provided in the lateral wall members 23 and in the walls 26 serve to hold filling members 29 which are formed analogously to the filling members 8 in FIG. 1 and comprise, on their radial sides 30, anchoring ribs like those designated 11 in FIG. 1.

The groove and rib arrangement 6/11 may alternatively be the other way round, and instead of a single anchoring region for each wall 3, 23 and radial side 9, 30, a plurality of ribs may be provided. Furthermore, the filling members 8, 29 may be hollow structures and the ribs 11 of the filling members may be made from a different material from that of the remainder of the filling members.

I claim:

1. A combination of a structure for supporting of walls or similar elements and at least one filling member comprising:

a plurality of elongated, interconnected arms, said arms extending radially and outwardly from a center of the structure, said arms having slot means for closely receiving said wall elements, at least one receiving zone being defined between two adjacent radial arms, said receiving zone being adapted to receive the sector-shaped filling member so that radially extending wall portions of said filling member are anchored between adjacent walls of different arms.

2. The combination according to claim 1 wherein the radially extended wall portions of the filling member(s) and the adjacent walls of the arms are provided with interlocking longitudinally extending engaging grooves and anchoring ribs which are substantially complimentary in a shape to the shape of said grooves for anchoring engagement therebetween.

* * * * *